US009033762B2

(12) United States Patent
Makiuchi

(10) Patent No.: US 9,033,762 B2
(45) Date of Patent: May 19, 2015

(54) METHOD AND DEVICE FOR PREVENTING SLIP OF WORK PIECE

(75) Inventor: Akira Makiuchi, Anjo (JP)

(73) Assignee: JTEKT Corporation, Osaka-shi (JP)

( * ) Notice: Subject to any disclaimer, the term of this patent is extended or adjusted under 35 U.S.C. 154(b) by 591 days.

(21) Appl. No.: 13/383,627

(22) PCT Filed: Jun. 28, 2010

(86) PCT No.: PCT/JP2010/060961

§ 371 (c)(1),
(2), (4) Date: Jan. 12, 2012

(87) PCT Pub. No.: WO2011/010528

PCT Pub. Date: Jan. 27, 2011

(65) Prior Publication Data

US 2012/0129433 A1 May 24, 2012

(30) Foreign Application Priority Data

Jul. 22, 2009 (JP) ..... 2009-170760
Jul. 22, 2009 (JP) ..... 2009-170833

(51) Int. Cl.
*B24B 49/10* (2006.01)
*B24B 51/00* (2006.01)
(Continued)

(52) U.S. Cl.
CPC ..... *B24B 41/062* (2013.01); *B24B 5/045* (2013.01); *B24B 49/10* (2013.01); *B24B 49/16* (2013.01)

(58) Field of Classification Search
CPC ..... B24B 51/00; B24B 41/065
USPC ..... 451/5, 8, 14, 17, 49, 243, 11, 143, 242, 451/246, 402; 409/79–80, 165–168, 409/131–132, 186–188, 193–195, 409/207–209; 82/118; 700/114, 164; 318/625–626
See application file for complete search history.

(56) References Cited

U.S. PATENT DOCUMENTS 3,618,270 A * 11/1971 Koide ..... 51/24
3,815,929 A * 6/1974 Steinberger et al. ..... 279/4.02
(Continued)

FOREIGN PATENT DOCUMENTS

JP 47 11269 4/1972
JP 48 45174 12/1973
(Continued)

OTHER PUBLICATIONS

International Search Report issued on Sep. 14, 2010 in PCT/JP10/060961 filed on Jun. 28, 2010.
(Continued)

*Primary Examiner* — Maurina Rachuba
*Assistant Examiner* — Marcel Dion
(74) *Attorney, Agent, or Firm* — Oblon, McClelland, Maier & Neustadt, L.L.P.

(57) ABSTRACT

A master servo motor and a slave servo motor that synchronously drive for rotation a master main spindle provided with a center that supports one end of a work piece and a slave main spindle provided with a center that supports the other end of the work piece are included. Before grinding, a slip detection cycle that detects a limit current value for the servo motors, at which the work piece and the centers slip, is executed and, during grinding, a grinding condition is changed to prevent a slip between the work piece and the centers in advance at the time when any one of current values of the servo motors has reached a slip threshold value set on the basis of the limit current value.

11 Claims, 10 Drawing Sheets

(51) Int. Cl.

| | |
|---|---|
| ***B24B 41/06*** | (2012.01) |
| ***B24B 5/04*** | (2006.01) |
| ***B24B 49/16*** | (2006.01) |

(56) References Cited

U.S. PATENT DOCUMENTS

| | | | | |
|---|---|---|---|---|
| 4,254,676 | A * | 3/1981 | Wilson | 82/152 |
| 5,525,092 | A * | 6/1996 | Hirano et al. | 451/5 |
| 6,827,631 | B2 * | 12/2004 | Tomotaki et al. | 451/11 |
| 6,913,522 | B2 * | 7/2005 | Junker | 451/49 |
| 2002/0173224 | A1 * | 11/2002 | Dougill et al. | 451/5 |
| 2004/0067719 | A1 * | 4/2004 | Zuniga | 451/8 |
| 2004/0072500 | A1 * | 4/2004 | Birang et al. | 451/5 |
| 2004/0192170 | A1 * | 9/2004 | Mizun | 451/5 |
| 2008/0042682 | A1 * | 2/2008 | Ammi | 324/772 |

FOREIGN PATENT DOCUMENTS

| | | |
|---|---|---|
| JP | 8 132338 | 5/1996 |
| JP | 9 295264 | 11/1997 |
| JP | 10 118923 | 5/1998 |
| JP | 2008 6543 | 1/2008 |
| JP | 2008 188742 | 8/2008 |
| JP | 2009-214276 A | 9/2009 |

OTHER PUBLICATIONS

Office Action issued Oct. 1, 2013, in Japanese Patent Application No. 2009-170760 (with English-language translation).

* cited by examiner

METHOD AND DEVICE FOR PREVENTING SLIP OF WORK PIECE

TECHNICAL FIELD

The invention relates to a method and device for preventing a slip of a work piece in a grinding machine that grinds the work piece in such a manner that both ends of the work piece are synchronously driven for rotation by the friction forces of centers.

BACKGROUND ART

There is known a grinding machine that increases the pressing force of centers to a work piece supported at both ends by the centers to synchronously drive both ends of the work piece for rotation with the friction forces of the centers to thereby grind the work piece as, for example, described in Patent Document 1. In the thus configured grinding machine, it is not necessary to chuck the end portions of a work piece or attach a drive fitting, so, for example, it is characterized in that the overall length of a cylindrical work piece may be ground without reclamping the cylindrical work piece, drive fittings, or the like, for various work pieces having different shapes may be not required, and various types of work pieces may be driven for rotation by only controlling the pressing force of the centers.

However, a work piece is driven by only the friction forces of the centers, so it is necessary to set sufficiently large pressing force of the centers in order to obtain friction forces such that a work piece does not slip because of grinding resistance. On the other hand, as the pressing force of the centers is excessively increased, a work piece warps to lead to a decrease in grinding accuracy, so there are technical restrictions that the pressing force of the centers cannot be blindly increased. Thus, depending on set center pressing force, the grinding resistance may be larger than the friction resistances of the centers and a slip may occur between the centers and a work piece to cause poor machining of the work piece.

Conventionally, there is, for example, known the technique for detecting a slip of a work piece as described in Patent Document 2 and Patent Document 3.

RELATED ART DOCUMENT

Patent Document

Patent Document 1: Japanese Patent Application Publication No. 8-132338

Patent Document 2: Japanese Utility Model Publication No. 47-11269

Patent Document 3: Japanese Utility Model Publication No. 48-45174

SUMMARY OF THE INVENTION

Problems to be Solved by the Invention

The techniques described in Patent Document 2 and Patent Document 3 utilize a non-circular portion of a work piece or a non-circular member mounted on a rolling center to detect an abnormal rotation of the work piece, so detecting an abnormal rotation is possible in a work piece having a non-circular portion, such as a camshaft and a crankshaft; however, there is a problem that an abnormal rotation cannot be detected unless a special center, or the like, described in Patent Document 3 is provided in a cylindrical work piece having no non-circular portion.

Moreover, the techniques described in the above Patent Document 2 and Patent Document 3 detect the result of a slip, and a work piece has been already abnormally rotating at the time of the detection, so there is a need for being able to detect a slip of a work piece in advance before the work piece slips.

The invention solves the above conventional problem and is made to satisfy the above need, and it is an object of the invention to provide a method and device for preventing a slip of a work piece, which are able to prevent a slip of the work piece in advance by changing a grinding condition before the work piece slips.

Means for Solving the Problems

A feature of the invention according to claim 1 is that, in a grinding machine that includes: a master main spindle provided with a center that supports one end of the work piece; a slave main spindle provided with a center that supports the other end of the work piece; and a master servo motor and a slave servo motor that synchronously drive the master main spindle and the slave main spindle for rotation, wherein at least one of the center provided for the master main spindle and the center provided for the slave main spindle is pressed toward the other one of the centers to generate friction forces between the work piece and the centers to thereby synchronously drive both ends of the work piece for rotation, and, in this state, a wheel head is caused to cut into the work piece to grind the work piece, before grinding, a slip detection cycle that detects a limit current value for the servo motors, at which the work piece and the centers slip, is executed; and, during grinding, when any one of current values of the servo motors has reached a slip threshold value set on the basis of the limit current value, changing a grinding condition to prevent a slip between the work piece and the centers in advance.

A feature of the invention according to claim 1, the slip detection cycle is configured to rotate at least one of the master main spindle and the slave main spindle by the servo motors to thereby detect the limit current value at which the work piece and the centers slip.

A feature of the invention according to claim 2 is that, in claim 1, the slip detection cycle is configured to rotate the master main spindle and the slave main spindle in opposite directions by the master servo motor and the slave servo motor to thereby detect the limit current values at which the work piece and the centers slip.

A feature of the invention according to claim 3 is that, in any one of claims 1 to 2, the grinding condition is changed by decreasing an infeed speed of the wheel head or controlling the pressing force of the centers.

A feature of the invention according to claim 4 is that, in claim 3, a center pressing device that automatically controls the pressing force of the centers on the basis of grinding resistance that occurs during rough grinding, precise grinding and fine grinding is provided.

A feature of the invention according to claim 5 is that, in claim 4, the center pressing device is configured to vary the center pressing force in a stepwise manner for each of the rough grinding, precise grinding and fine grinding.

A feature of the invention according to claim 6 is that, in claim 5, the center pressing device is configured to vary the center pressing force steplessly with progress of the rough grinding, precise grinding and fine grinding.

A feature of the invention according to claim 7 is that, in claim 4, the center pressing device is configured to vary the center pressing force in a curved line with progress of the rough grinding, precise grinding and fine grinding.

A feature of the invention according to claim 8 is that, in any one of claims 4 to 7, the grinding machine includes a steady rest device that stops vibrations of the work piece, and the center pressing device is configured to increase the center pressing force when the steady rest device is inserted onto the work piece being ground.

A feature of the invention according to claim 9 is that, in any one of claims 1 to 3, when the grinding condition is changed, grinding data of the next work piece is corrected to the changed grinding condition.

A feature of the invention according to claim 10 is that, in a grinding machine that includes: a master main spindle provided with a center that supports one end of the work piece; a slave main spindle provided with a center that supports the other end of the work piece; and a master servo motor and a slave servo motor that synchronously drive the master main spindle and the slave main spindle for rotation, wherein at least one of the center provided for the master main spindle and the center provided for the slave main spindle is pressed toward the other one of the centers to generate friction forces between the work piece and the centers to thereby synchronously drive both ends of the work piece for rotation, and, in this state, a wheel head is caused to cut into the work piece to grind the work piece, a prescribed current value is set in advance; and, in a repeating production cycle, a simplified cycle that proceeds to a grinding cycle when the prescribed current value is reached at the time when at least one of the master main spindle and the slave main spindle is rotated by the servo motors in a state where the work piece is supported between the master main spindle and the slave main spindle is executed.

A feature of the invention according to claim 11 is that, in a grinding machine that includes a master main spindle provided with a center that supports one end of the work piece; a slave main spindle provided with a center that supports the other end of the work piece; and a master servo motor and a slave servo motor that synchronously drive the master main spindle and the slave main spindle for rotation, wherein the center provided for the slave main spindle is pressed toward the center provided for the master main spindle to generate friction forces between the work piece and the centers to thereby synchronously drive both ends of the work piece for rotation and, in this state, a wheel head is caused to cut into the work piece to grind the work piece, detecting means for, before grinding, detecting a limit current value for the servo motors, at which the work piece and the centers slip; computing means for computing a slip threshold value on the basis of the limit current value; storage means for storing the slip threshold value computed by the computing means; and grinding condition changing means for, during grinding, changing a grinding condition such that the work piece and the centers do not slip at the time when any one of current values of the servo motors has reached the slip threshold value.

Advantageous Effects of the Invention

With the invention according to claim 1, before grinding, the step detection cycle that detects the limit current value for the servo motors, at which the work piece and the centers slip, is executed, and, during grinding, the grinding condition is changed to prevent a slip between the work piece and the centers in advance when any one of the current values of the servo motors has reached the slip threshold value set on the basis of the limit current value, so it is possible to implement safe grinding with no slip of the work piece. Moreover, not the non-slip condition is calculated through calculation but friction resistance at which a slip occurs is measured before grinding on the machine, so it is possible to carry out high accuracy measurement, and it is possible to reliably prevent a slip between the work piece and the centers.

With the invention according to claim 1, the slip detection cycle is configured to rotate at least one of the master main spindle and the slave main spindle by the servo motors to thereby detect the limit current value at which the work piece and the centers slip, so it is possible to measure friction resistance that causes a slip in a condition close to actual machining.

With the invention according to claim 2, the slip detection cycle is configured to rotate the master main spindle and the slave main spindle in opposite directions by the master servo motor and the slave servo motor to thereby detect the limit current value at which the work piece and the centers slip, so it is possible to set a smaller one of the current value of the master servo motor and the current value of the slave servo motor as an upper limit value.

With the invention according to claim 3, the grinding condition is changed by decreasing the infeed speed of the wheel head or controlling the pressing force of the centers, so, after any one of the current values of the servo motors has reached the slip threshold value set on the basis of the limit current value, the grinding condition is changed to make it possible to reduce the current values of the servo motors, and it is possible to reliably prevent a slip between the work piece and the centers.

With the invention according to claim 4, the center pressing device that automatically controls the center pressing force on the basis of grinding resistance that occurs during rough grinding, precise grinding and fine grinding is provided, so, during rough grinding having a large grinding resistance, the center pressing force is increased to prevent a slip of the work piece, while, during precise grinding and fine grinding, the center pressing force is reduced with a reduction in grinding resistance to minimize deformation of the work piece while preventing a slip of the work piece to thereby make it possible to implement highly accurate grinding.

With the invention according to claim 5, the center pressing device is configured to vary the center pressing force in a stepwise manner for each of rough grinding, precise grinding and fine grinding, so the center pressing force may be controlled on the basis of grinding resistance that occurs during rough grinding, precise grinding and fine grinding, and it is possible to minimize deformation of the work piece while preventing a slip of the work piece.

With the invention according to claim 6, the center pressing device is configured to vary the center pressing force steplessly with progress of the rough grinding, precise grinding and fine grinding, so the center pressing force may be reduced with a reduction in the diameter of the work piece resulting from each grinding step.

With the invention according to claim 7, the center pressing device is configured to vary the center pressing force in a curved line with progress of grinding steps of the rough grinding, precise grinding and fine grinding, so it is possible to control the center pressing force so as to be appropriate to grinding resistance that actually occurs, and it is possible to control the center pressing force to the minimum force by which no slip or deformation of the work piece occurs.

With the invention according to claim 8, the grinding machine includes a steady rest device that stops vibrations of the work piece, and the center pressing device is configured to increase the center pressing force when the steady rest device is inserted onto the work piece being ground, so, irrespective of an increase in friction resistance resulting from insertion of the steady rest device, it is possible not to cause a slip between the work piece and the centers.

With the invention according to claim 9, when the grinding condition is changed, grinding data of the next work piece is corrected to the changed grinding condition, so, in the next grinding, the current values of the servo motors may be kept at or below the slip threshold value.

With the invention according to claim 10, a prescribed current value is set in advance; and, in a repeating production cycle, a simplified cycle that proceeds to a grinding cycle when the prescribed current value is reached at the time when at least one of the master main spindle and the slave main spindle is rotated by the servo motors in a state where the work piece is supported between the master main spindle and the slave main spindle is executed, so, in the repeating production cycle, it is possible to execute the simplified cycle in a short period of time, and it is possible to improve the degree of safety.

With the invention according to claim 11, detecting means that, before grinding, detects a limit current value for the servo motors, at which the work piece and the centers slip; computing means that computes a slip threshold value on the basis of the limit current value; storage means that stores the slip threshold value computed by the computing means; and grinding condition changing means that, during grinding, changes a grinding condition such that the work piece and the centers do not slip at the time when any one of current values of the servo motors has reached the slip threshold value, are provided, so it is possible to implement the grinding machine that is able to reliably prevent a slip between the work piece and the centers during grinding on the basis of data detected in advance.

DESCRIPTION OF EMBODIMENTS

Figure 1:
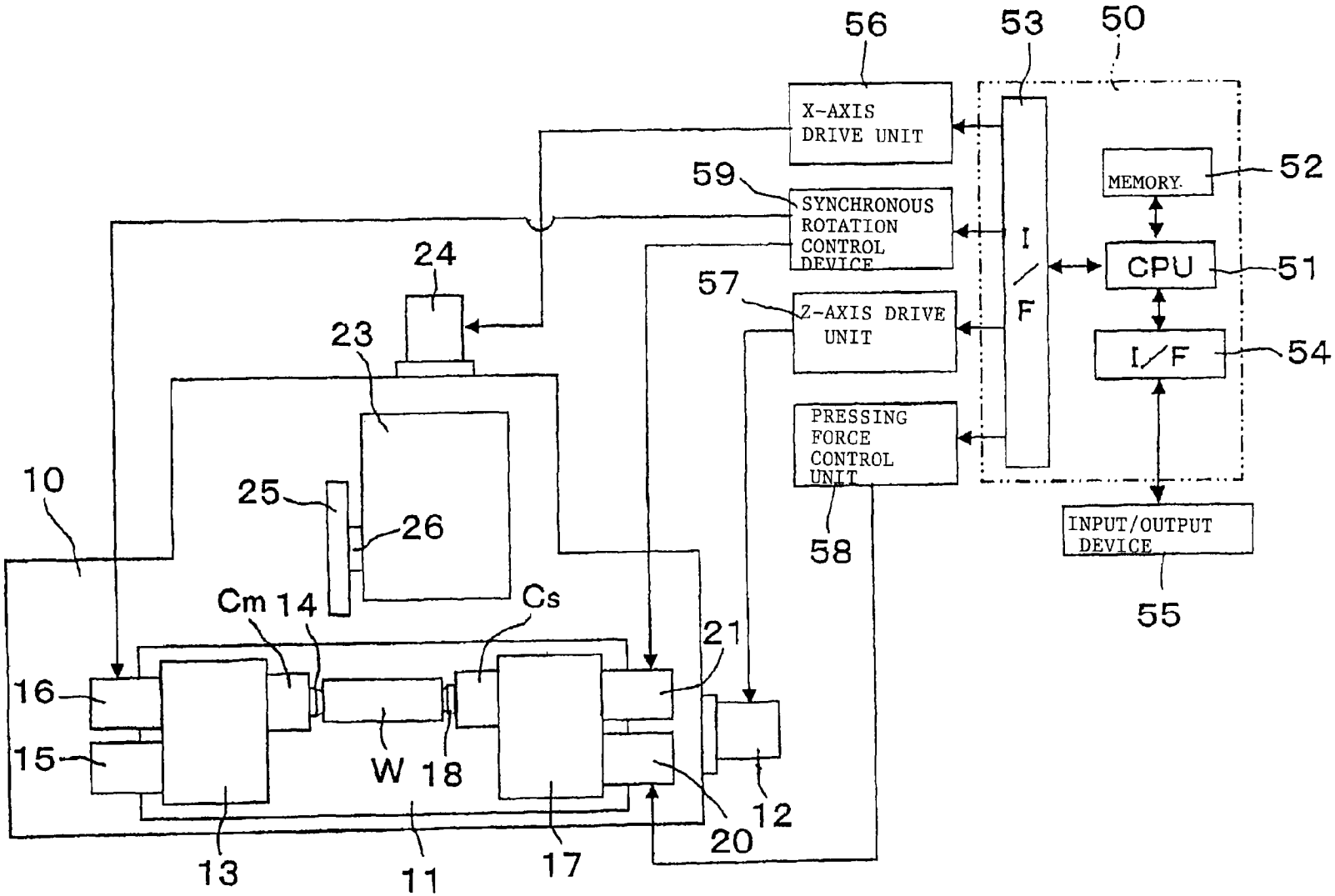
FIG. 1 is an overall view of a grinding machine suitable for carrying out the invention.

Hereinafter, an embodiment of the invention will be described with reference to the drawings. As shown in FIG. 1, a table 11 is guided and supported movably in a Z-axis direction (horizontal direction in FIG. 1) by a Z-axis servo motor 12 on a bed 10 of a grinding machine. A headstock 13 that rotatably supports a master main spindle Cm is installed on the table 11, and a center 14 that supports one end of a work piece W is mounted at the distal end of the master main spindle Cm. The master main spindle Cm is configured to move forward or backward by a predetermined amount in the axial direction by a forward/backward driving device 15, and is configured to be driven for rotation by a master servo motor 16.

A tailstock 17 is installed at a position facing the headstock 13 on the table 11. A slave main spindle Cs is rotatably supported by the tailstock 17 coaxially with the master main spindle Cm, and a center 18 that supports the other end of the work piece W is mounted at the distal end of the slave main spindle Cs. The slave main spindle Cs is configured to move forward or backward in the axial direction by a servo motor 20 for center pressing control, and is configured to be driven for rotation by a slave servo motor 21 in synchronization with the master main spindle Cm.

In addition, a wheel head 23 is guided and supported at a position on the rear side of the table 11 on the bed 10 so as to be movable in an X-axis direction (vertical direction in FIG. 1) perpendicular to the Z-axis direction by an X-axis servo motor 24. A grinding wheel 25 is supported by the wheel head 23 via a grinding wheel shaft 26 that is rotatable about an axis parallel to the Z-axis direction, and is driven for rotation by a grinding wheel shaft drive motor (not shown).

Next, the configuration for controlling the pressing force of the centers 14 and 18 will be described with reference to FIG. 2. A tail ram 31 that rotatably supports the slave main spindle Cs via a bearing 30 is supported by the tailstock 17 so as to be slidable in the axial direction of the slave main spindle Cs. A motor shaft 21*a* of the slave servo motor 21 is coupled to the rear end of the slave main spindle Cs, and the slave main spindle Cs is configured to be driven for rotation by the slave servo motor 21 in synchronization with the master main spindle Cm.

A coupling plate 32 is fixed to the rear end of the tail ram 31, and the coupling plate 32 has a spring receiving portion 32*a* that extends in the radial direction of the tail ram 31. A ball screw shaft 33 is arranged parallel to the tail ram 31 on the tailstock 17 with a predetermined gap from the tail ram 31 in the radial direction, and the ball screw shaft 33 is supported so as to be only rotatable about the axis parallel to the tail ram 31. A ball nut 34 is screwed to the ball screw shaft 33, and the ball nut 34 is supported by the tailstock 17 so as to be only slidable in the axial direction. A spring receiving portion 34*a* that faces the spring receiving portion 32*a* extended from the coupling plate 32 is provided for the ball nut 34 so as to extend in the radial direction of the ball screw shaft 33.

A pressing spring 35 is inserted between the spring receiving portion 34*a* of the ball nut 34 and the spring receiving portion 32*a* of the coupling plate 32, and the tail ram 31 is urged by the spring force of the pressing spring 35 in a direction to move the tail ram 31 forward toward the center 14. The motor shaft 20*a* of the servo motor 20 for center pressing force control is coupled to one end of the ball screw shaft 33, and the ball nut 34 is moved in the axial direction of the ball screw shaft 33, that is, a direction to compress the pressing spring 35 or a direction to move away from the pressing spring 35 by controlling the servo motor 20 for rotation. By so doing, the spring force of the pressing spring 35 is changed.

The above described servo motor 20 for center pressing force control, ball screw shaft 33, ball nut 34, pressing spring 35, and the like, constitute a center pressing device 37.

Figure 2:
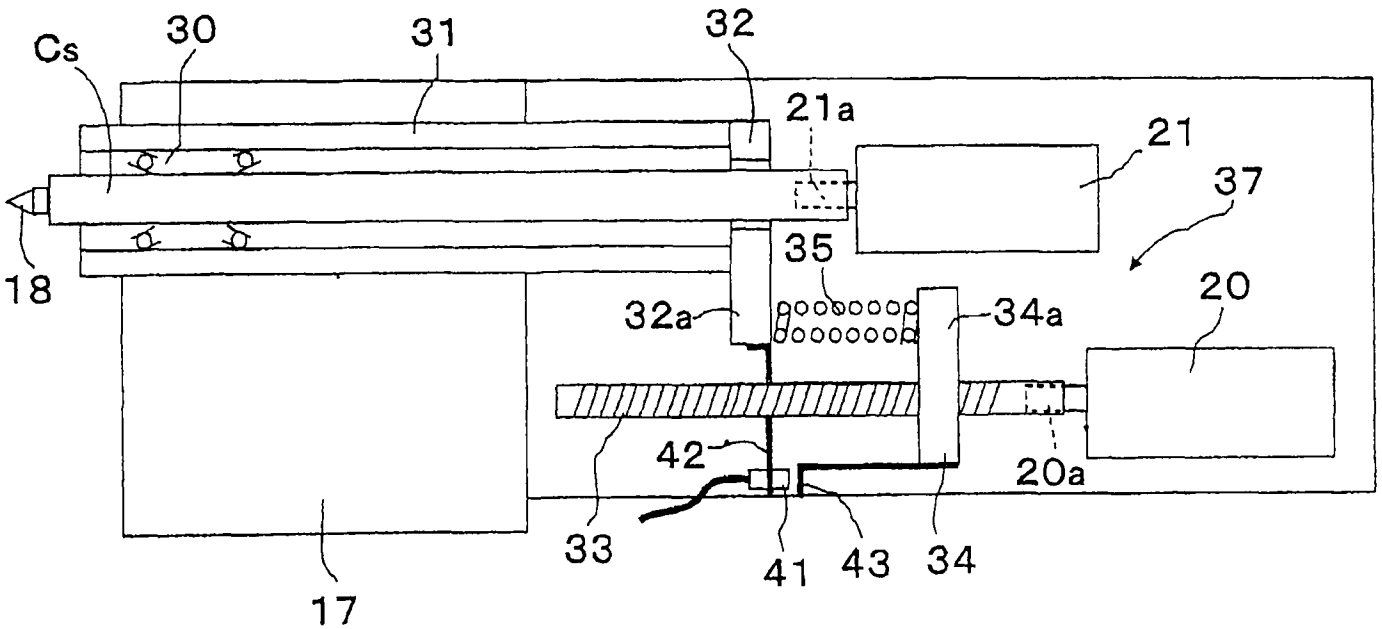
FIG. 2 is a schematic view that shows a center pressing device.

Although illustration is omitted in FIG. 2, the tail ram 31 and the ball nut 34 are associated with each other so as to be relatively movable by a predetermined amount in the axial direction of the tail ram 31 within the range that does not interfere with extension and contraction of the pressing spring 35. By so doing, the tail ram 31 may be moved backward by moving the ball nut 34 backward.

The reference numeral 41 in FIG. 2 denotes an eddy current sensor that determines the amount by which the pressing spring 35 is pushed in by the ball nut 34, and the eddy current sensor 41 is fixed to the coupling plate 32 via a mounting bracket 42. The eddy current sensor 41 is configured to measure the distance from an iron plate member 43 fixed to the ball nut 34 so as to be able to verify that the pressing spring 35 is compressed to a target compression amount.

As shown in FIG. 1, a numerical control device 50 that controls the grinding machine is mainly formed of a central processing unit (CPU) 51, a memory 52 that stores various control values and programs, and interfaces 53 and 54. Both a control parameter input from an input/output device 55 and an NC program for carrying out grinding are stored in the memory 52. In addition, the memory 52 stores a slip threshold value A2 that is computed on the basis of a limit current value (limit C axis current value) A1 for preventing a slip of the work piece W and stores a correspondence table between the center pressing force and the rotation amount of the servo motor 20 in correspondence with each grinding step of rough grinding, precise grinding and fine grinding for each type of work piece W. The above correspondence table, for example, defines the correlation between the center pressing force based on grinding resistance that occurs during rough grinding (precise grinding, fine grinding) of a work piece W and the spring force of the pressing spring 35, required to generate the center pressing force, that is, the rotation amount of the servo motor 20 as data. Various data are input to the numerical control device 50 via the input/output device 55, and the input device 55 includes a keyboard for, for example, inputting data and a display device that displays data.

The numerical control device 50 is configured to control an X-axis drive unit 56 that gives an instructed drive signal to the X-axis servo motor 24 that moves the wheel head 23 in the X-axis direction, and is configured such that an encoder (not shown) mounted on the X-axis servo motor 24 sends out the rotational position of the X-axis servo motor 24, that is, the position of the wheel head 23, to the numerical control device 50. In addition, the numerical control device 50 is configured to control an X-axis drive unit 57 that gives a drive signal to the Z-axis servo motor 12 that moves the table 11 in the Z-axis direction, and is configured such that an encoder (not shown) mounted on the Z-axis servo motor 12 sends out the rotational position of the Z-axis servo motor 12, that is, the position of the table 11, to the numerical control device 50.

Then, the numerical control device 50 drives the Z-axis and X-axis servo motors 12 and 24 respectively on the basis of deviations between target position commands of the NC program, stored in the memory 52, and current position signals from the encoders, and executes control to position the table 11 and the wheel head 23 respectively at target positions.

In addition, the numerical control device 50 is configured to control a pressing force control unit 58 that gives an instructed drive signal to the servo motor 20 for center pressing force control and to control a synchronous rotation control device 59 that controls the master servo motor 16 and the slave servo motor 21 for synchronous rotation.

Next, a slip detection cycle that detects the limit C axis current value A1 for the master servo motor 16 and the slave servo motor 21, at which the work piece W and the centers 14 and 18 slip, will be described with reference to the flow chart shown in FIG. 3.

Figure 4:
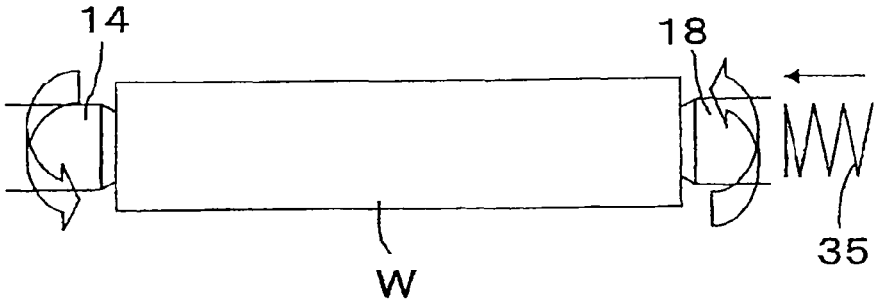
FIG. 4 is a view that shows the rotating state of a master main spindle and the rotating state of a slave main spindle during the slip detection cycle.
Figure 5:
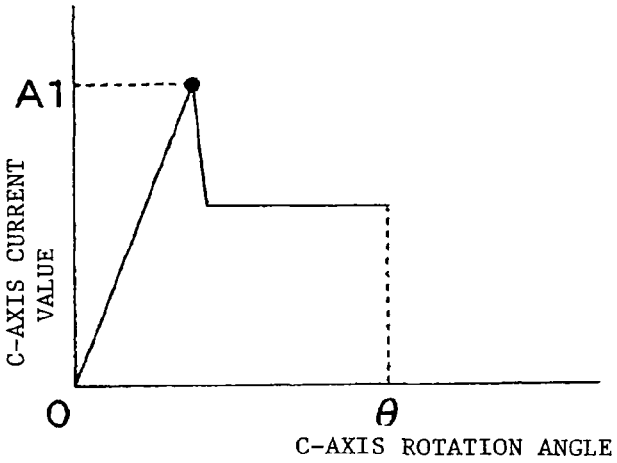
FIG. 5 is a view that shows changes in C axis current value in the slip detection cycle.

Before executing a grinding cycle, a work piece W is carried in between both the centers 14 and 18 (step S11), the center 18 provided for the slave main spindle Cs is moved forward by the center pressing device 37 toward the center 14 provided for the master main spindle Cm (step S12) to apply pressure to thereby clamp the work piece W with both the centers 14 and 18 at a regular pressing force. After that, as shown in FIG. 4, the master main spindle Cm and the slave main spindle Cs are rotated at an angle θ in opposite directions by the master servo motor 16 and the slave servo motor 21 (step S13).

At this time, friction torque that interferes with the rotation of the master main spindle Cm and the rotation of the slave main spindle Cs by friction resistance resulting from the center pressing force is generated between the work piece W and both the centers 14 and 18. In contrast to this, the master main spindle Cm and the slave main spindle Cs intend to rotate to the target angle, and, in order to generate torque that overcome the friction torque acting between the work piece W and both the centers 14 and 18, a large load current gradually flows in the master servo motor 16 and the slave servo motor 21. Then, at the time when the torque (C axis torques) from the master main spindle Cm and the slave main spindle Cs becomes larger than the friction torque between the work piece W and both the centers 14 and 18, a slip occurs in any one of the left and right centers 14 and 18. As a slip occurs, the friction torque between the work piece W and both the centers 14 and 18 changes into kinetic friction resistance, so load currents in the master servo motor 16 and the slave servo motor 21 decrease.

Thus, the C axis current values (load current values) of the master servo motor 16 and slave servo motor 21 until the master main spindle Cm and the slave main spindle Cs rotate by the angle θ each form an waveform that becomes maximal just before a slip occurs between the work piece W and both the centers 14 and 18 and that decreases because of kinetic friction resistance load after the slip. Then, the maximum current value just before a slip occurs between the work piece W and both the centers 14 and 18 is detected as the limit C axis current value A1 (step S14), and is taken into the numerical control device 50 and stored. In this case, when the maximum value of the load current value differs between the master servo motor 16 and the slave servo motor 21, the smaller load current value is stored as the limit C axis current value A1. The above described step S14 constitutes means for detecting a limit current value.

Figure 6:
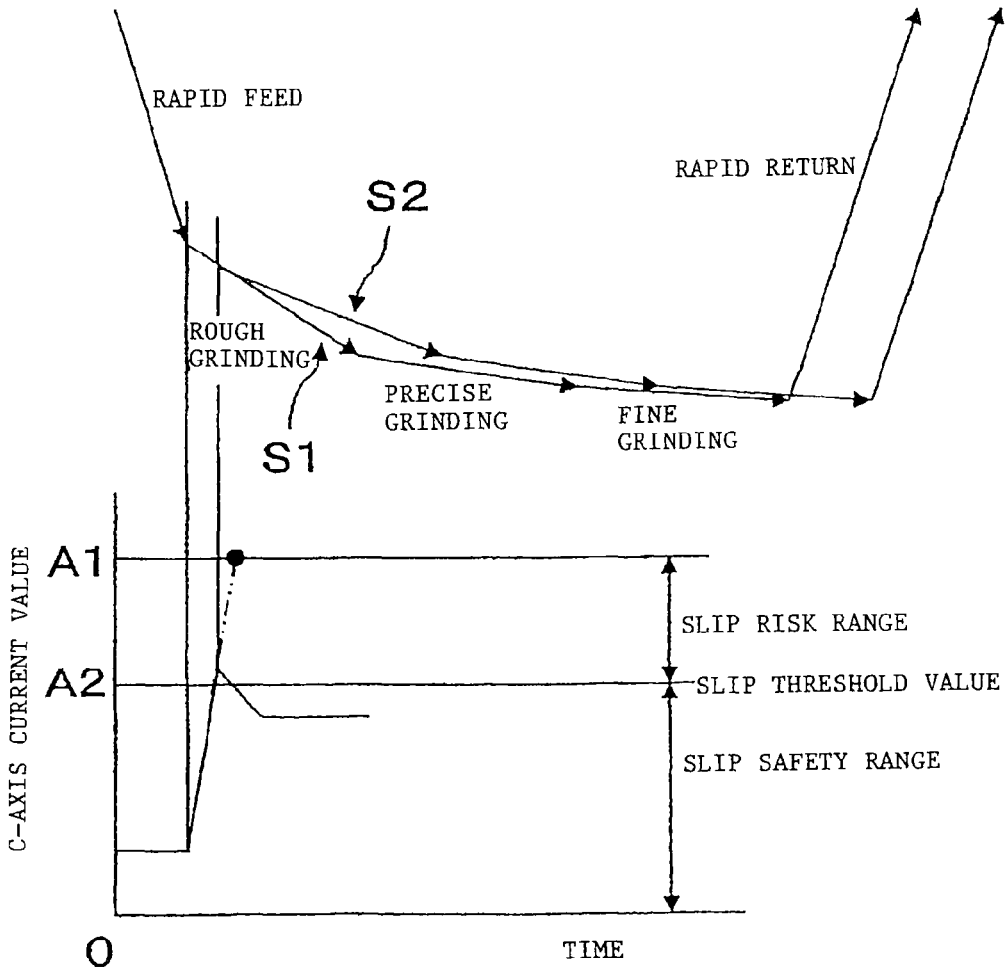
FIG. 6 is a view that shows a grinding cycle that prevents a slip of a work piece during actual grinding.

Subsequently, both the centers 14 and 18 are moved backward (step S15), and, in that state, the master main spindle Cm and the slave main spindle Cs are rotated in the direction opposite to the above by the angle θ by the master servo motor 16 and the slave servo motor 21 to return the master main spindle Cm and the slave main spindle Cs to an initial absolute origin (step S16), and, finally, the slip threshold value A2 is computed on the basis of the above described limit C axis current value A1 (step S17) and is stored in the memory 52 of the numerical control device 50, after which the slip detection cycle is completed. As shown in FIG. 6, the slip threshold value A2 is obtained by multiplying the limit C axis current value A1 by a factor of safety, and indicates that no slip occurs when controlled to fall within the slip threshold value A2. The above described step S17 constitutes computing means for computing the slip threshold value A2, and, in addition, the above described memory 52 constitutes storage means for storing the slip threshold value A2.

Even during actual grinding, in the case where reverse torque with respect to the master main spindle Cm and the slave main spindle Cs acts on the work piece W because of grinding resistance, it may be understood such that a slip occurs in any one of the left and right centers 14 and 18 when the load current value of the master servo motor 16 or slave servo motor 21 has reached the above described limit C axis current value A1.

Then, as shown in FIG. 6, the limit C axis current value A1 is multiplied by the factor of safety to obtain the slip threshold value A2 as a safety range in which no slip occurs, and is stored in the memory 52 of the numerical control device 50, the load current value of the master servo motor 16 or slave servo motor 21 is constantly monitored during grinding, and, when the load current value exceeds the slip threshold value A2, the feed speed of the wheel head 23 is, for example, reduced to decrease grinding resistance. By so doing, safe grinding with no occurrence of a slip may be carried out.

Next, a method of preventing a slip of the work piece in the above described embodiment will be described with reference to the cycle diagram of FIG. 6 and the flow chart of FIG. 7.

As the work piece W is carried in between the headstock 21 and the tailstock 22 on the table 13, the servo motor 20 for center pressing force control is driven, and the ball screw shaft 33 is rotated. With the rotation of the ball screw shaft 33, the ball nut 34 is moved in the axial direction of the ball screw shaft 33, and the pressing spring 35 is compressed. With the compression of the pressing spring 35, the tail ram 18 is moved forward, the center 18 of the slave main spindle Cs supported by the tail ram 18 engages with a center hole of the work piece W, and the work piece W is pressed toward the master main spindle Cm. As the center hole of one end of the work piece W engages with the center 14 of the master main spindle Cm, forward movement of the tail ram 18 is stopped, and, furthermore, with the rotation of the servo motor 20, the pressing spring 35 is compressed to increase the center pressing force. The compression amount of the pressing spring 35 is controlled by the rotation amount of the servo motor 20 for center pressing force control, and the center pressing force is set to a predetermined value.

Note that the compression amount of the pressing spring 35, that is, the relative positional relationship between the tail ram 18 and the nut member 34, may be detected in such a manner that the eddy current sensor 41 measures the distance to the iron plate member 42 fixed to the nut member 34. Thus, for example, when the pressing spring 35 is not compressed to a predetermined compression amount because of an abnormality, or the like, of the center hole of the work piece W, this may be detected on the basis of an output of the eddy current center 4, and an abnormal signal may be sent out.

Subsequently, the master servo motor 16 is started up to drive the master main spindle Cm for rotation, and the slave main spindle Cs is driven for rotation by the slave servo motor 21 in synchronization with the master main spindle Cm, and the work piece W is driven for rotation by the interaction of friction engagement between the centers 14 and 18, provided respectively for the master main spindle Cm and the slave main spindle Cs, and the center holes of the work piece W. At the same time, the wheel head 23 is moved forward in the X-axis direction sequentially at a rapid feed speed, a rough grinding feed speed, a precise grinding feed speed and a fine grinding feed speed, and the grinding cycle for grinding the work piece W is carried out by the grinding wheel 25 (step 100 in FIG. 7).

Subsequently, it is determined in step 102 whether the grinding cycle has been completed. When the grinding cycle has not been completed (N), it is determined in the next step 104 whether the load current value (C axis current value) of any one of the master servo motor 16 and the slave servo motor 21 exceeds the slip threshold value A2. When the C axis current value does not exceed the slip threshold value A2 (N), the grinding cycle is continued; however, when the C axis current value exceeds the slip threshold value A2 (Y), control is executed in step 106 so as to reduce the X-axis feed speed of the wheel head 23 using override function. With such a reduction in the X-axis feed speed, grinding resistance that acts during grinding of the work piece W is decreased, so it is possible to prevent the C axis current value from increasing any more. The above described step 106 constitutes grinding condition changing means for changing a grinding condition in the claims.

For example, as indicated by the grinding cycle diagram of FIG. 6, when the C axis current value exceeds the slip threshold value A2 in process of rough grinding of the work piece W, the rough grinding feed speed is changed from an original predetermined feed speed to a feed speed that is decreased by a constant rate. That is, as shown in FIG. 6, by changing the grinding condition so as to shift the grinding cycle of S1 to the grinding cycle of S2, it is possible to prevent a slip of the work piece W in advance.

In the above described step 102, when it is determined that the grinding cycle has been completed (Y), it is determined in step 108 whether it is necessary to change grinding cycle data. That is, when the grinding condition is changed, it is highly likely to exceed the slip threshold value A2 even during grinding of the next work piece W unless the grinding cycle data is changed from S1 to S2 in FIG. 6, so, in such a case, it is determined that it is necessary to change the grinding cycle data (Y), and the grinding cycle data is changed in the next step 110, after which the program is returned. The above processing is employed so as not to exceed the slip threshold value A2 during grinding of the next work piece W.

Note that changing the grinding condition may be executing control so as to increase the center pressing force, other than decreasing the feed speed of the wheel head 23. Center pressing force control will be described later.

In addition, even when the rough grinding feed speed of the wheel head 23 is overridden during rough grinding to change the rough grinding feed speed, precise grinding or fine grinding is performed at an initially set precise grinding feed speed during precise grinding or fine grinding feed speed during fine grinding after rough grinding. Then, when there occurs a situation that the C axis current value exceeds the slip threshold value A2 during the precise grinding or fine grinding, the precise grinding feed speed or fine grinding feed speed just needs to be overridden to decrease the feed speed as in the case of the above.

On the other hand, when the grinding condition is changed on the basis of the fact that the C axis current value exceeds the slip threshold value A2 as well, the next work piece W may be ground using original grinding cycle data. Then, when there occurs a situation that the C axis current value exceeds the slip threshold value A2 through grinding, the grinding condition may be changed as the situation arises.

Incidentally, in a production line in which an identical work piece is repeatedly ground, when the above described slip detection cycle is repeated each time a work piece W is ground, it leads to a decrease in grinding efficiency. Therefore, in a production line in which an identical work piece is repeatedly ground, the above described slip detection cycle may be executed only when a first article work piece is ground or may be executed periodically like once a day or once a week.

Figure 7:
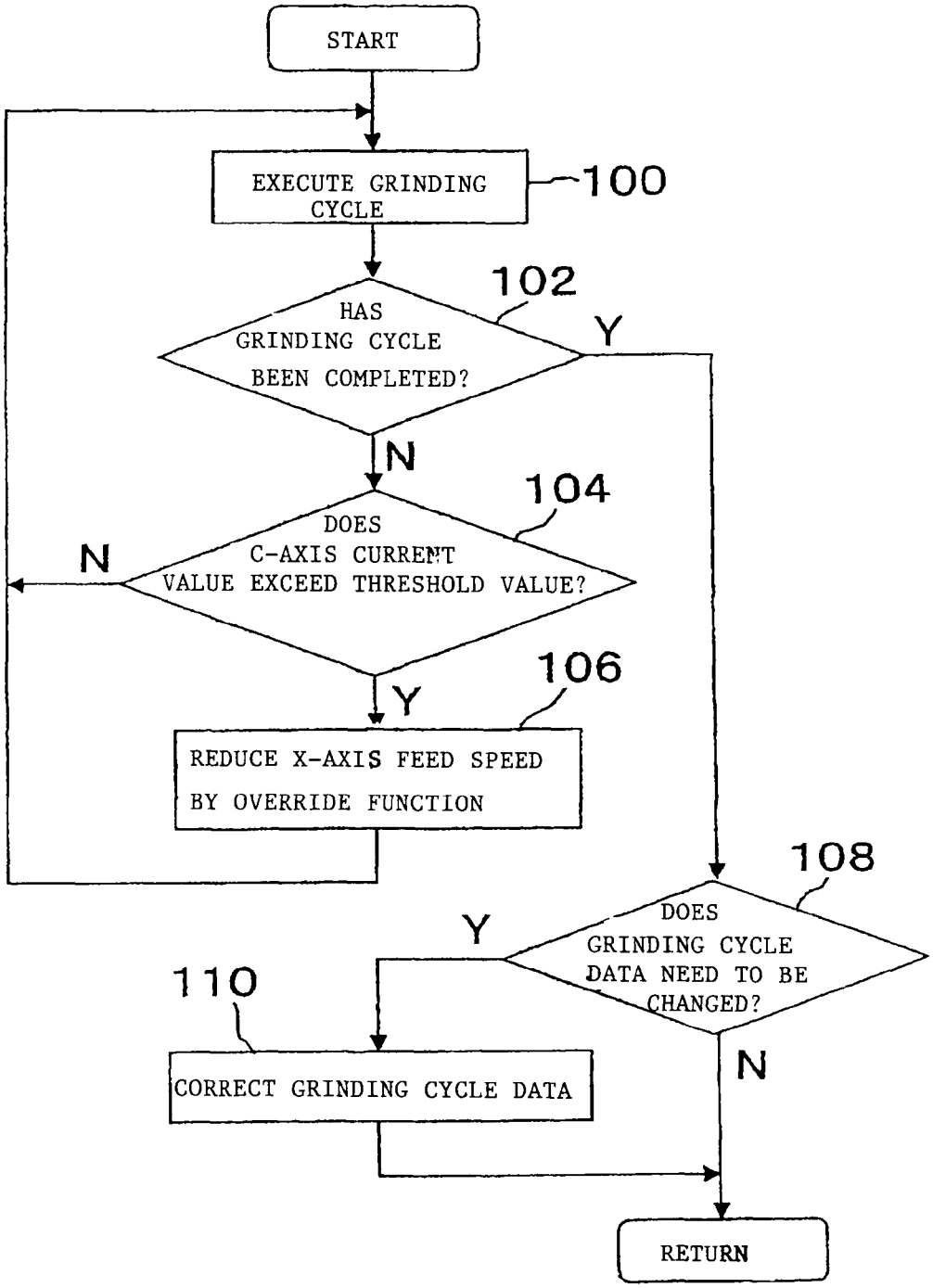
FIG. 7 is a flow chart that prevents a slip of a work piece during actual grinding.
Figure 8:
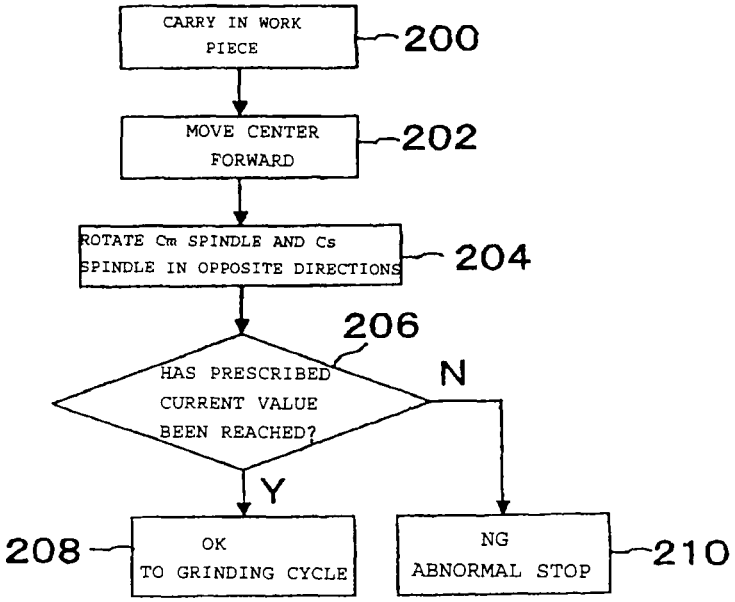
FIG. 8 is a view that shows a simplified cycle of the slip detection cycle.

Furthermore, when an identical work piece is repeatedly ground, the simplified cycle shown in FIG. 8 may be executed or both the simplified cycle of FIG. 8 and the slip detection cycle of FIG. 7 may be executed. By adding the simplified cycle of FIG. 8, it is possible to improve the degree of safety.

As shown in FIG. 8, in the simplified cycle, a work piece W is carried in between both the centers 14 and 18 before grinding (step 200), the center 18 provided for the slave main spindle Cs is moved forward by the center pressing device 37 toward the center 14 provided for the master main spindle Cm (step 202), and the centers 14 and 18 are pressed to clamp the work piece W with both the centers 14 and 18 at a regular pressing force. After that, the master main spindle Cm and the slave main spindle Cs are rotated by the angle θ in opposite directions by the master servo motor 16 and the slave servo motor 21 (step 204).

Up to this point, it is the same as the above described slip detection cycle; however, in the simplified cycle, after the master main spindle Cm and the slave main spindle Cs are rotated in opposite directions, it is determined in step 206 whether any one of the master servo motor 16 and the slave servo motor 21 has reached a prescribed current value (for example, the above described slip threshold value A2). When it has reached the prescribed current value, it means that the center holes of the work piece W are respectively engaged with the centers 14 and 18 at sufficient friction force, so it is determined as OK and the process proceeds to the grinding cycle (step 208). When it has not reached the prescribed current value, it means that the work piece W and the centers 14 and 18 slip before reaching the predetermined current value because of inclusion of foreign matter in between the work piece W and the center 14 or 18, an abnormality of the work piece W, an abnormality of the center 14 or 18, or the like, so it is determined as NG to carry out an abnormal stop (step 210).

With the above simplified cycle, it is not necessary to rotate the master main spindle Cm and the slave main spindle Cs by the angle θ until the work piece W and the centers 14 and 18 slip, and, in addition, it is not necessary to move the centers 14 and 18 backward as described in the step diagram of the slip detection cycle to return by rotating the master main spindle Cm and the slave main spindle Cs by the angle θ, so it is possible to carry out the simplified cycle in a short period of time.

In addition, the prescribed current value may be set on the basis of an experiment, or the like, in advance other than on the basis of the limit current value A1 detected through the above described slip detection cycle.

With the above described embodiment, the slip detection cycle for detecting the limit C axis current value A1 at which the work piece W and the centers 14 and 18 slip is executed before grinding, and, during grinding, when any one of the load current values (C axis current values) of the master servo motor 16 and slave servo motor 21 has reached the slip threshold value A2 set on the basis of the limit C axis current value A1, for example, the feed speed of the wheel head 23 is decreased or the center pressing force is increased to change the grinding condition. By so doing, it is possible to implement safe grinding without a slip of the work piece W.

Moreover, not the non-slip condition is calculated through calculation but friction resistance at which a slip occurs is measured using an actual work piece W before grinding on the machine, so it is possible to carry out high accuracy measurement, and it is possible to reliably prevent a slip between the work piece W and the centers 14 and 18.

In addition, with the above described embodiment, in a repeating production cycle, the simplified cycle is executed in which, at the time of rotating the master main spindle Cm and the slave main spindle Cs in opposite directions by the master servo motor 16 and the slave servo motor 21, when the slip threshold value A2 is reached, it is determined that sufficient friction resistance is acting and is determined as OK to proceed to the grinding cycle, so it is not necessary to rotate the master main spindle Cm and the slave main spindle Cs until the work piece W and the centers 14 and 18 slip, and it is possible to execute the slip detection cycle in a short period of time.

In the above described embodiment, an example in which the master main spindle Cm and the slave main spindle Cs are rotated by the master servo motor 16 and the slave servo motor 21 by the angle θ in opposite directions during the slip detection cycle and during the simplified cycle is described; instead, it is also applicable that the limit C axis current value A1 is obtained in such a manner that, in a state where one of the master servo motor 16 and the slave servo motor 21 is fixed, only the other one is rotated in one direction by a predetermined angle.

In the above described embodiment, an example in which the center pressing device 37 is provided at the side of the tailstock 17 and the center 18 provided for the slave main spindle Cs is pressed toward the center 14 provided for the master main spindle Cm is described; instead, it is also applicable that the center pressing device 37 is provided at the side of the headstock 12 and the center 14 provided for the master main spindle Cm is pressed toward the center 18 provided for the slave main spindle Cs or it is also applicable that both the center 14 provided for the master main spindle Cm and the center 18 provided for the slave main spindle Cs are pressed by the center pressing device 37.

Figure 9:
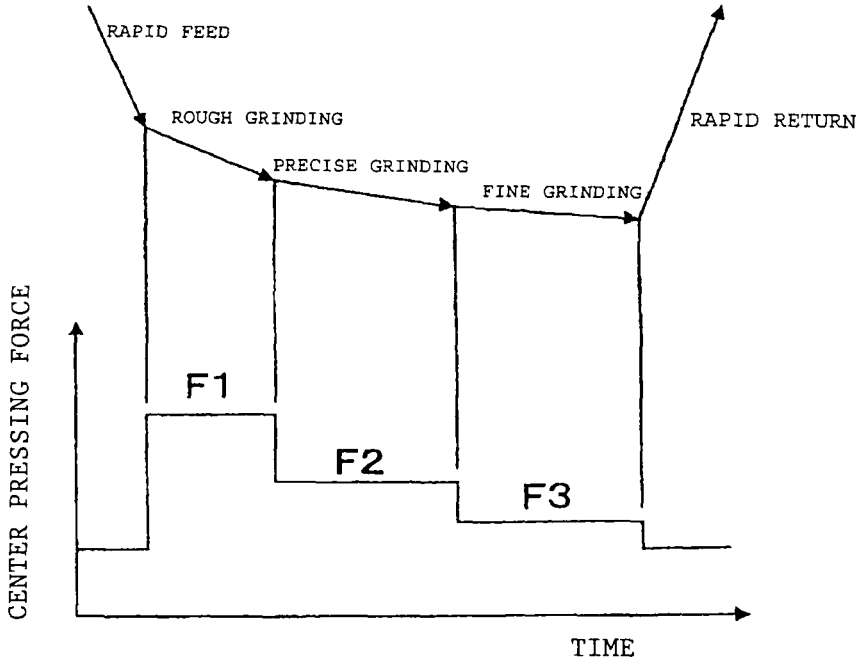
FIG. 9 is a view that shows a grinding cycle that changes center pressing force in a stepwise manner on the basis of a grinding step.

Next, center pressing force control will be described. The compression amount of the pressing spring 35 is controlled by the rotation amount of the servo motor 37 for center pressing force control, and, as shown in FIG. 9, the center pressing force is set to a center pressing force F1 based on grinding resistance that occurs during rough grinding. As the fact that the wheel head 23 is moved forward to a predetermined position at the rough grinding feed speed is detected on the basis of a feedback signal from the encoder (not shown), the feed speed of the wheel head 23 is converted to precise grinding feed, and the servo motor 20 for center pressing force control is controlled for rotation by the pressing force control unit 58 on the basis of a command from the numerical control device 50, and, as shown in FIG. 9, the center pressing force is decreased to a center pressing force F2 based on grinding resistance that occurs during precise grinding. In this state, the work piece W is subjected to precise grinding by the grinding wheel 24. During the above precise grinding, the center pressing force is decreased with grinding resistance that acts on the work piece W, so it is possible to highly accurately perform precise grinding without warpage of the work piece W.

Furthermore, as the fact that the wheel head 23 is moved forward to a predetermined position at the precise grinding feed speed is detected on the basis of a feedback signal from the encoder (not shown), the feed speed of the wheel head 23 is converted to fine grinding feed, and the servo motor 20 for center pressing force control is controlled for rotation by the pressing force control unit 58 on the basis of a command from the numerical control device 50, and, as shown in FIG. 9, the center pressing force is decreased to a center pressing force F3 based on slight grinding resistance that occurs during fine grinding. In this state, the work piece W is subjected to fine grinding by the grinding wheel 24. After completion of fine grinding, the wheel head 23 is stopped for a constant period of time, spark-out of the work piece W is performed, and, after that, the wheel head 23 is returned rapidly to the original position, after which the grinding cycle of the work piece W is completed. After that, the servo motor 20 for center pressing force control is driven in a direction opposite to the above to move the tail ram 31 backward to the original position, and the work piece W is carried out from between both the centers 14 and 18.

Figure 10:
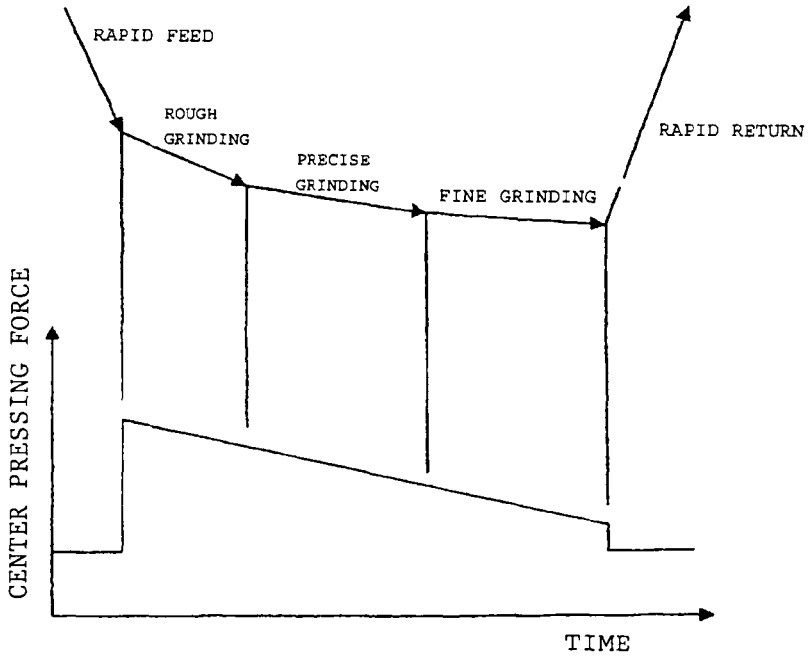
FIG. 10 is a view that shows a grinding cycle that steplessly changes center pressing force on the basis of a grinding step.

Next, an alternative example of the above described embodiment will be described. FIG. 10 shows that the center pressing force is gradually decreased in a continuous straight line with transition from rough grinding to fine grinding. That is, with the progress of rough grinding, precise grinding and fine grinding, the servo motor 2 for center pressing force control is continuously controlled at a constant speed. With the above, even during rough grinding (precise grinding, fine grinding), grinding resistance varies with a reduction in the diameter of the work piece W, so the center pressing force may be continuously controlled in correspondence with the variation.

Figure 11:
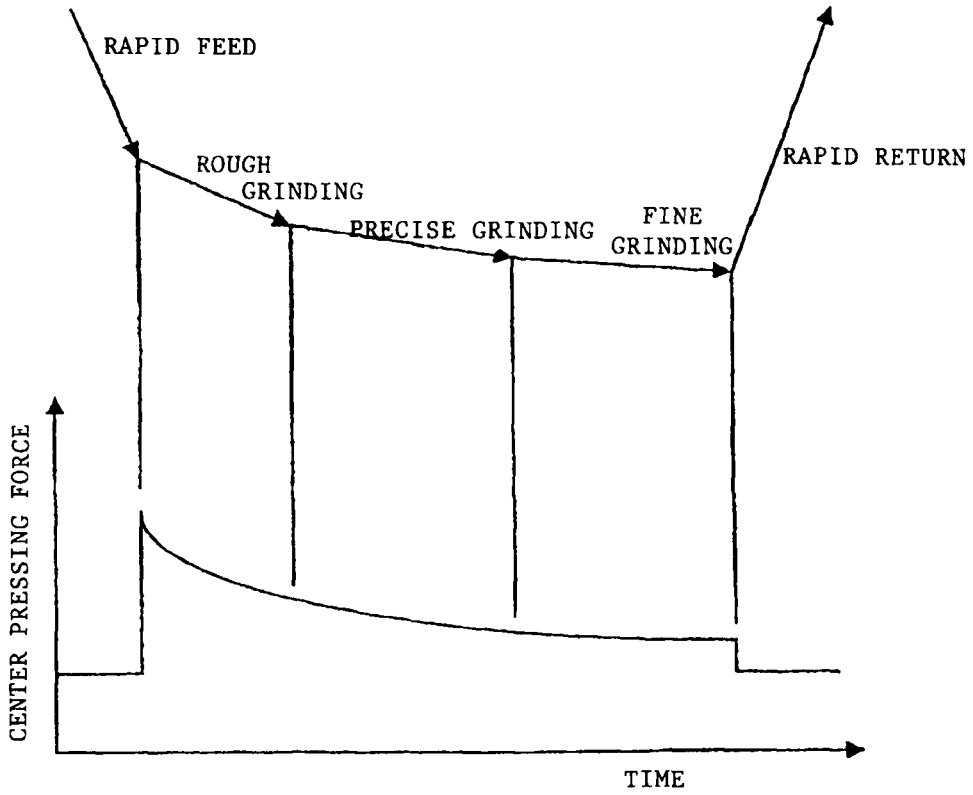
FIG. 11 is a view that shows a grinding cycle that changes center pressing force in a curved line on the basis of a grinding step.
Figure 11:
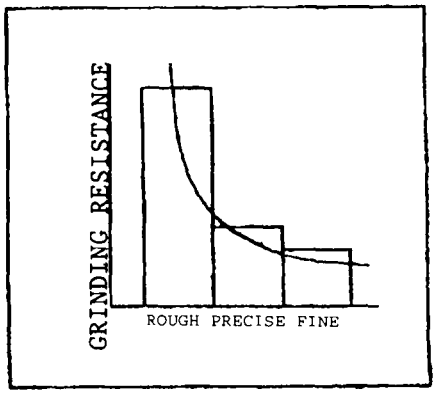

In addition, FIG. 11 shows that the center pressing force is gradually decreased along a curved line that is approximated to a quadratic curve with transition from rough grinding to fine grinding. That is, the servo motor 20 for center pressing force control is continuously controlled while varying the speed with the progress of rough grinding, precise grinding and fine grinding. This is, as shown in the box of the drawing, grinding resistance during rough grinding, during precise grinding and during fine grinding does not vary proportionally but varies in a quadratic curve manner, so it is possible to control the center pressing force to force that is further suitable for an actual condition.

Figure 12:
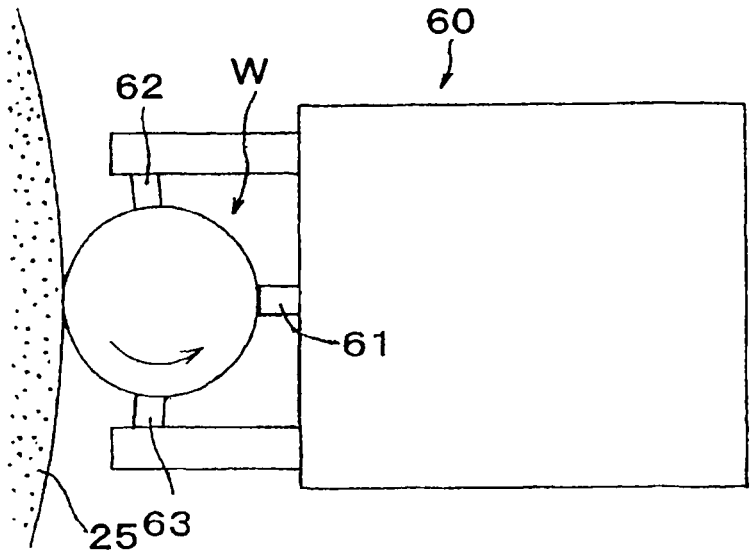
FIG. 12 is a view that shows a steady rest device that prevents vibrations of a work piece.

FIG. 12 to FIG. 15 show further another alternative example, and it is intended to be applied to a grinding machine that includes a steady rest device 60 that prevents vibrations of a work piece W. The steady rest device 60 is installed on the bed 11 at an opposite side of the work piece W with respect to the wheel head 17, and, for example, as shown in FIG. 12, includes a side shoe 61 that supports the work piece Win a lateral direction in which the work piece W faces the grinding wheel 25, an upper shoe 62 that supports the work piece W from an upper side and a lower shoe 63 that suppresses upward vibrations of the work piece W.

In the grinding machine that includes the steady rest device 60, by inserting the steady rest device 60 on the work piece W, friction resistance that occurs between the steady rest shoes and the work piece W is applied to the work piece W in addition to grinding resistance, and it is necessary to increase the center pressing force by the amount of the friction resistance. Therefore, the memory 52 (see FIG. 1) of the numerical control device 50 stores the amount of increase in center pressing force based on friction resistance that occurs between the shoes 61, 62 and 63 and the work piece W because of insertion of the steady rest device 60 for each of precise grinding and fine grinding.

Figure 13:
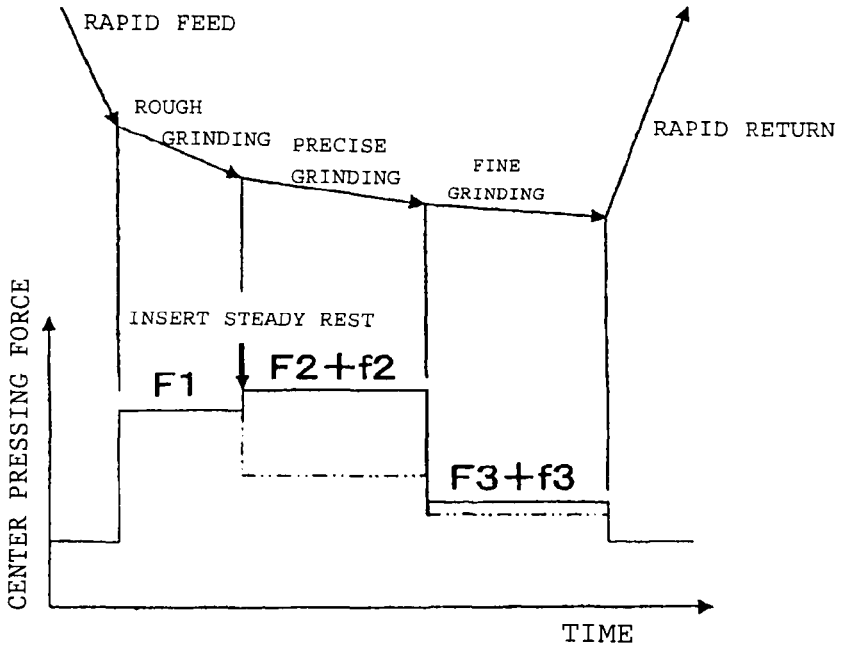
FIG. 13 is a view that shows a grinding cycle that changes center pressing force in a stepwise manner with insertion of the steady rest device.

Thus, as shown in FIG. 13, in the grinding machine in which the steady rest device 60 is inserted between rough grinding and precise grinding, the center pressing force during precise grinding is set as a combined value of the center pressing force F2 based on grinding resistance that occurs during precise grinding and the center pressing force f2 based on friction resistance that occurs because of the steady rest device 60, and, similarly, the center pressing force during fine grinding is set as a combined value of the center pressing force F3 based on grinding resistance that occurs during fine grinding and the center pressing force f3 based on friction resistance that occurs because of the steady rest device 60.

Figure 14:
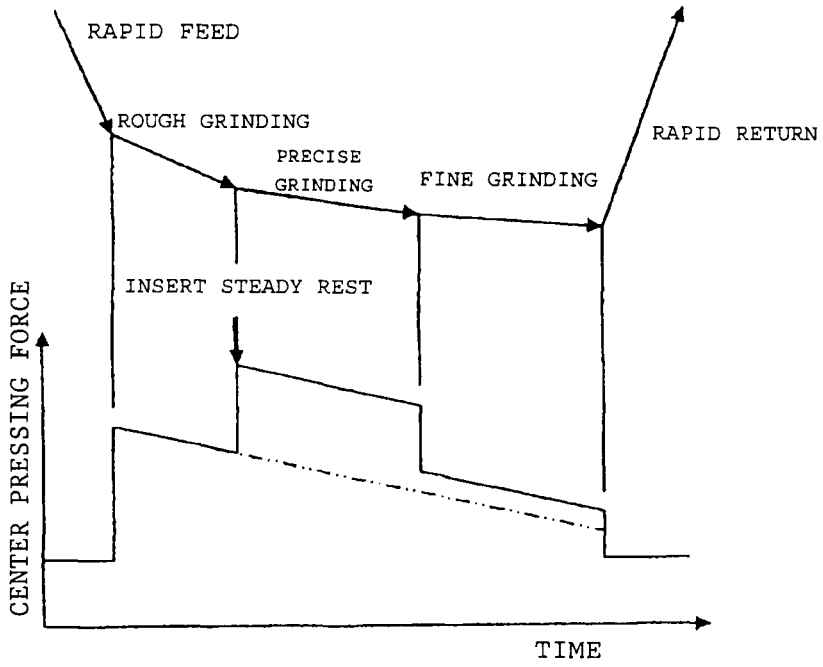
FIG. 14 is a view that shows a grinding cycle that steplessly changes center pressing force with insertion of the steady rest device.
Figure 15:
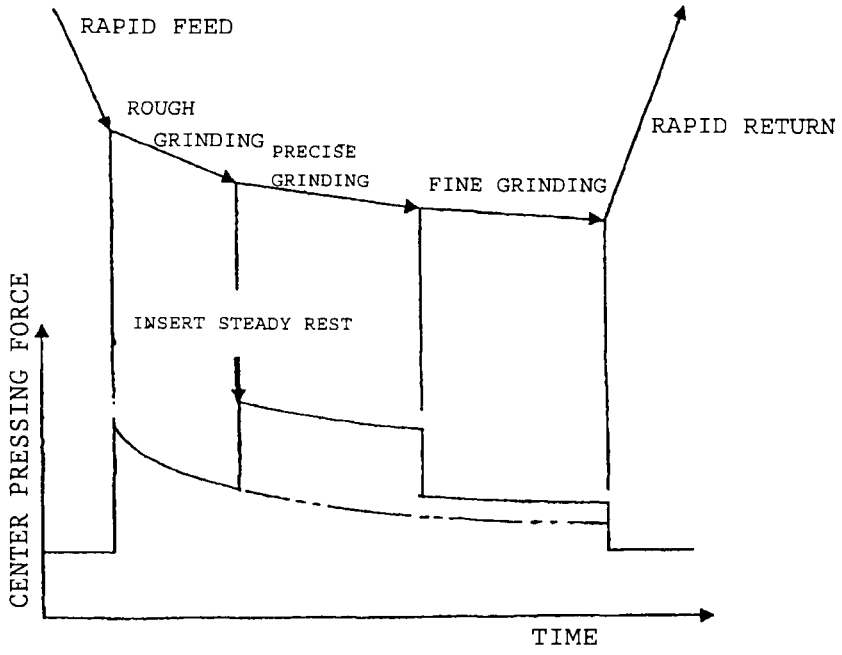
FIG. 15 is a view that shows a grinding cycle that changes center pressing force in a curved line with insertion of the steady rest device.

In addition, as shown in FIG. 14, in the configuration that the center pressing force is gradually reduced in a continuous straight line as shown in FIG. 10, the center pressing force is increased by the amount of friction resistance due to the steady rest device 60 so as to translate the straight line during rough grinding and fine grinding when the steady rest device 60 is inserted on the work piece W. Furthermore, as shown in FIG. 15, in the configuration that the center pressing force is decreased in a curved line as shown in FIG. 11, the center pressing force is increased by the amount of friction resistance due to the steady rest device 60 so as to translate the curved line during rough grinding and during precise grinding when the steady rest device 60 is inserted on the work piece W.

With the above described embodiment, the center pressing force is varied in a stepwise manner, varied steplessly or varied in a curved line on the basis of grinding resistance that occurs during rough grinding, precise grinding and fine grinding, so, during rough grinding having a large grinding resistance, the center pressing force is increased to make it possible to prevent a slip of the work piece W, while, during precise grinding and fine grinding, the center pressing force is reduced with a reduction in grinding resistance to make it possible to minimize deformation of the work piece W. It is possible to implement highly accurate grinding.

In addition, with the above described embodiment, when the steady rest device 60 that stops vibrations of the work piece W is inserted on the work piece W being ground, the center pressing force is increased with an increase in friction resistance due to the steady rest device 60, so, irrespective of an increase in friction resistance due to insertion of the steady rest device 60, it is possible to reliably prevent a slip between the work piece W and the centers 14 and 18.

In addition, in the above described embodiment, the pressing force of the centers 14 and 18 is controlled by the spring force of the pressing spring 35; however, control over the center pressing force may not be necessarily spring force, and, for example, it may be performed by air pressure using an air cylinder or hydraulic pressure using a hydraulic cylinder.

Figure 3:
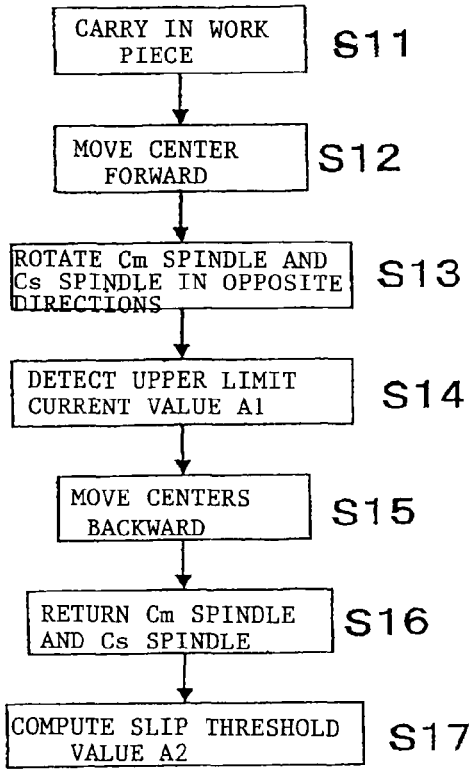
FIG. 3 is a flow chart that shows steps of a slip detection cycle.

Furthermore, in the above described embodiment, an example in which the slip threshold value at the time of the simplified cycle of the slip detection cycle is set to the same value as the slip threshold value A2 of the slip detection cycle shown in FIG. 3 is described; instead, the slip threshold value at the time of the simplified cycle may not be necessarily the same as the slip threshold value A2 of the slip detection cycle and may be set to another value.

As described above, the invention is described using the embodiment; however, the invention is not limited to the configuration described in the embodiment, and may be modified into various forms without departing from the scope of the invention described in the appended claims.

INDUSTRIAL APPLICABILITY

A method and device for preventing a slip of a work piece according to the invention are suitable in use for a grinding machine that performs grinding in such a manner that the centers are pressed to synchronously drive both ends of the work piece W for rotation with the friction forces of the centers 14 and 18.

DESCRIPTION OF REFERENCE NUMERALS

11 table
12 headstock
Cm master main spindle
14 center
16 master servo motor
17 tailstock
Cs slave main spindle
18 center
20 servo motor for center pressing force control
21 slave servo motor
23 wheel head
31 tail ram
35 pressing spring
37 center pressing device
50 numerical control device
60 steady rest device
W work piece
A1 limit current value
A2 slip threshold value

The invention claimed is:

1. A method for preventing a slip of a work piece in a grinding machine that includes: a master main spindle provided with a center that supports one end of the work piece; a slave main spindle provided with a center that supports the other end of the work piece; and a master servo motor and a slave servo motor that synchronously drive the master main spindle and the slave main spindle for rotation, wherein at least one of the center provided for the master main spindle and the center provided for the slave main spindle is pressed toward the other one of the centers to generate friction forces between the work piece and the centers to thereby synchronously drive both ends of the work piece for rotation, and, in this state, a wheel head is caused to cut into the work piece to grind the work piece, comprising:

before grinding, executing a slip detection cycle that detects a limit current value for the servo motors, at which the work piece and the centers slip, and during grinding, when any one of current values of the servo motors has reached a slip threshold value computed on the basis of the limit current value, changing a grinding condition to prevent a slip between the work piece and the centers in advance, wherein the slip detection cycle is configured to rotate at least one of the master main spindle and the slave main spindle by a corresponding one of the master servo motor and the slave servo motor to thereby detect the limit current value at which the work piece and the centers slip.

2. The method for preventing a slip of a work piece in a grinding machine according to claim 1, wherein the slip detection cycle is configured to rotate the master main spindle and the slave main spindle in opposite directions by the master servo motor and the slave servo motor to thereby detect the limit current value at which the work piece and the centers slip.

3. The method for preventing a slip of a work piece in a grinding machine according to claim 1, wherein the grinding condition is changed by decreasing an infeed speed of the wheel head or controlling a pressing force of the centers.

4. The method for preventing a slip of a work piece in a grinding machine according to claim 3, wherein a center pressing device that automatically controls the pressing force of the centers is provided.

5. The method for preventing a slip of a work piece in a grinding machine according to claim 4, wherein the center pressing device is configured to vary the center pressing force in a stepwise manner for each of rough grinding, precise grinding and fine grinding.

6. The method for preventing a slip of a work piece in a grinding machine according to claim 4, wherein the center pressing device is configured to vary the center pressing force steplessly with progress of the rough grinding, precise grinding and fine grinding.

7. The method for preventing a slip of a work piece in a grinding machine according to claim 4, wherein the center pressing device is configured to vary the center pressing force in a curved line with progress of the rough grinding, precise grinding and fine grinding.

8. The method for preventing a slip of a work piece in a grinding machine according to claim 4, wherein the grinding machine includes a steady rest device that stops vibrations of the work piece, and the center pressing device is configured to increase the center pressing force when the steady rest device is inserted onto the work piece being ground.

9. The method for preventing a slip of a work piece in a grinding machine according to claim 1, further comprising, when the grinding condition is changed, correcting grinding data of the next work piece to the changed grinding condition.

10. A method for preventing a slip of a work piece in a grinding machine that includes: a master main spindle provided with a center that supports one end of the work piece; a slave main spindle provided with a center that supports the other end of the work piece; and a master servo motor and a slave servo motor that synchronously drive the master main spindle and the slave main spindle for rotation, wherein at least one of the center provided for the master main spindle and the center provided for the slave main spindle is pressed toward the other one of the centers to generate friction forces between the work piece and the centers to thereby synchronously drive both ends of the work piece for rotation, and, in this state, a wheel head is caused to cut into the work piece to grind the work piece, comprising:

setting a prescribed current value in advance; and in a repeating production cycle, executing a simplified cycle that proceeds to a grinding cycle when the prescribed current value is reached at the time when at least one each of the master main spindle and the slave main spindle is rotated by a corresponding one of the servo motors in a state where the work piece is supported between the master main spindle and the slave main spindle.

11. A grinding machine that includes a master main spindle provided with a center that supports one end of the work piece; a slave main spindle provided with a center that supports the other end of the work piece; and a master servo motor and a slave servo motor that synchronously drive the master main spindle and the slave main spindle for rotation, wherein the center provided for the slave main spindle is pressed toward the center provided for the master main spindle to generate friction forces between the work piece and the centers to thereby synchronously drive both ends of the work piece for rotation and, in this state, a wheel head is caused to cut into the work piece to grind the work piece, comprising:

a detector that, before grinding, detects a limit current value for the servo motors, at which the work piece and the centers slip;

circuitry configured to compute a slip threshold value on the basis of the limit current value; and memory that stores the slip threshold value computed by the circuitry, wherein the circuitry is further configured to change, during grinding, a grinding condition such that the work piece and the centers do not slip at the time when any one of current values of the servo motors has reached the slip threshold value, wherein while detecting the limit current value, at least one of the master main spindle and the slave main spindle is configured to be rotated by a corresponding one of the master servo motor and the slave servo motor to thereby detect the limit current value at which the work piece and the centers slip.

* * * * *